US005284028A

United States Patent [19]

Stuhmer

[11] Patent Number: 5,284,028

[45] Date of Patent: Feb. 8, 1994

[54] ICE HOLDER INCORPORATED WITHIN A BEVERAGE CONTAINER

[76] Inventor: Wilco R. Stuhmer, 4688 Namba Way, Salt Lake City, Utah 84107

[21] Appl. No.: 996,624

[22] Filed: Dec. 24, 1992

[51] Int. Cl.[5] ..... F25D 3/08

[52] U.S. Cl. ..... 62/457.3; 62/530; 220/703

[58] Field of Search ..... 62/457.2, 457.3, 529, 62/530; 220/504, 527, 530, 703

[56] References Cited

U.S. PATENT DOCUMENTS

| | | | |
|---|---|---|---|
| 76,378 | 4/1868 | Bailey . | |
| 93,001 | 7/1869 | Pietsch . | |
| 249,642 | 11/1881 | Lenz et al. . | |
| 416,356 | 12/1889 | Clark . | |
| 966,278 | 8/1910 | Weeks . | |
| 1,186,418 | 6/1916 | Mischo . | |
| 2,409,279 | 10/1946 | Hiller . | |
| 3,369,369 | 2/1968 | Weiss . | |
| 3,605,433 | 9/1971 | Strathaus . | |
| 3,741,383 | 6/1973 | Wittwer | 206/47 A |
| 3,802,220 | 4/1974 | Pompo | 62/530 |
| 4,005,586 | 2/1977 | Lyons . | |
| 4,306,424 | 12/1981 | Chavoor | 62/457.2 |
| 4,530,220 | 7/1985 | Namba et al. | 62/530 |
| 4,974,423 | 12/1990 | Pring . | |
| 5,044,173 | 9/1991 | Cheng | 62/372 |
| 5,090,213 | 2/1992 | Glassman | 62/457.3 |

*Primary Examiner*—Henry A. Bennet
*Assistant Examiner*—William C. Doerrler
*Attorney, Agent, or Firm*—Thomas I. Rozsa; Dong Chen

[57] ABSTRACT

The present invention is a liquid beverage container which keeps the beverages chilled for an extended period of time. The beverage container has two chambers: there is a chamber for the liquid beverage; and there is an ice chamber, sealed with a cap and separated from the liquid beverage chamber by a thin polymeric film pouch, which can be filled with ice to retain the cool liquid beverage.

47 Claims, 3 Drawing Sheets

FIG. 1
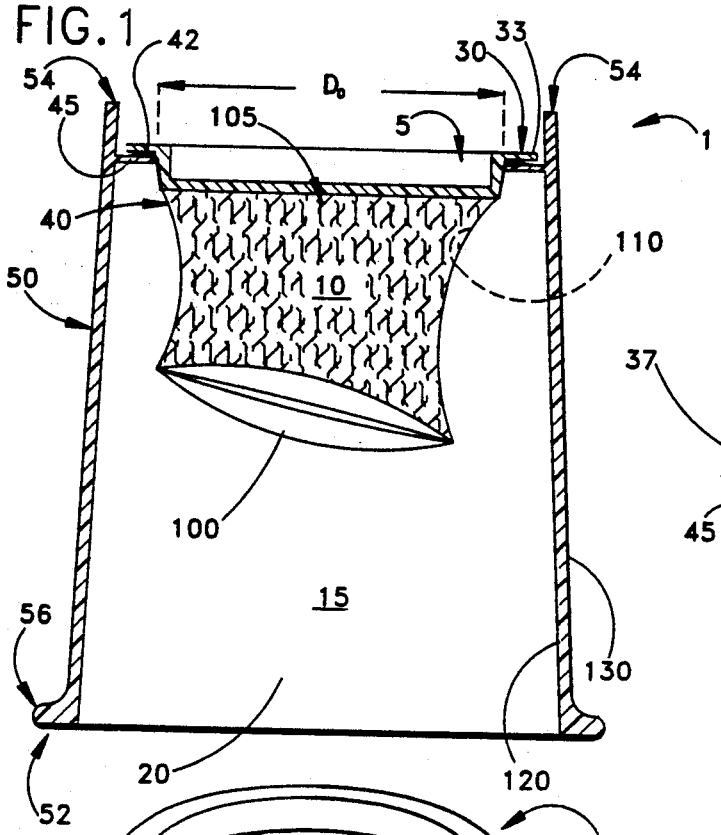
FIG. 3
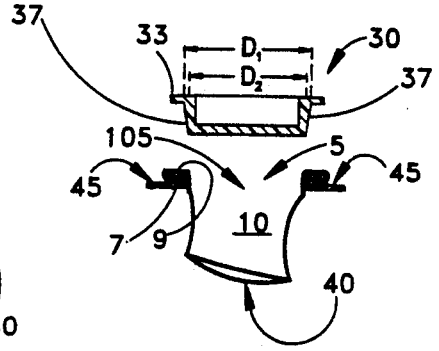
FIG. 4
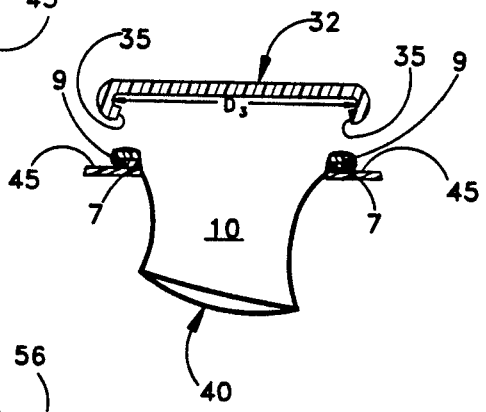
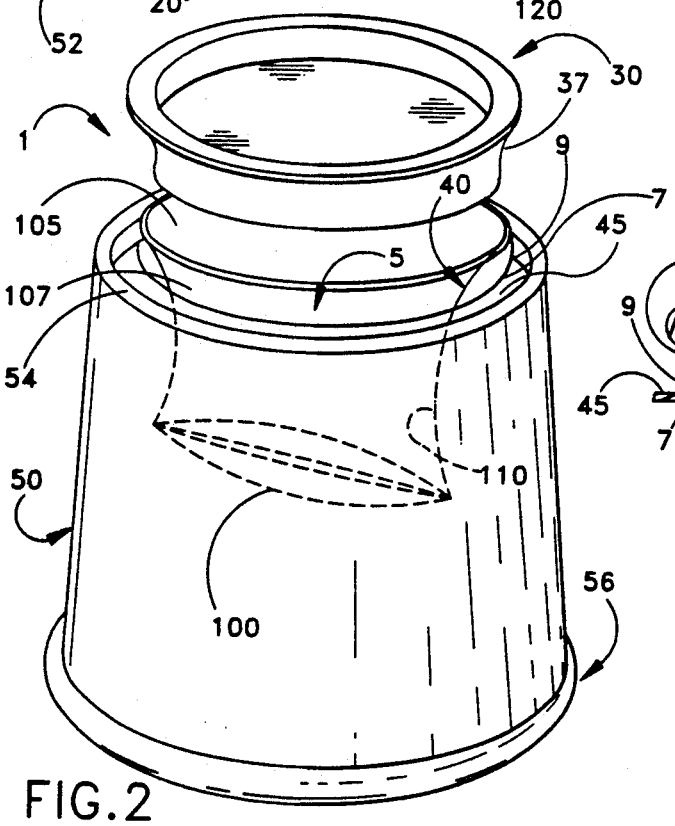
FIG. 2

FIG.5
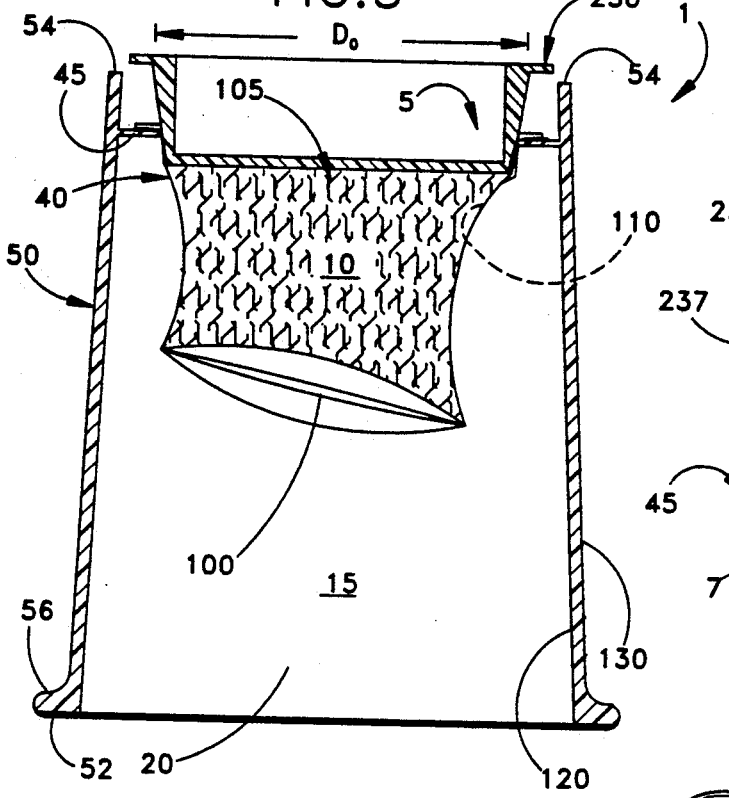
FIG.6
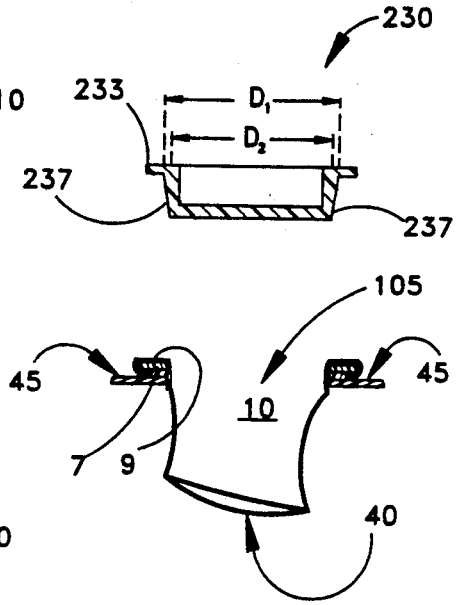
FIG.8
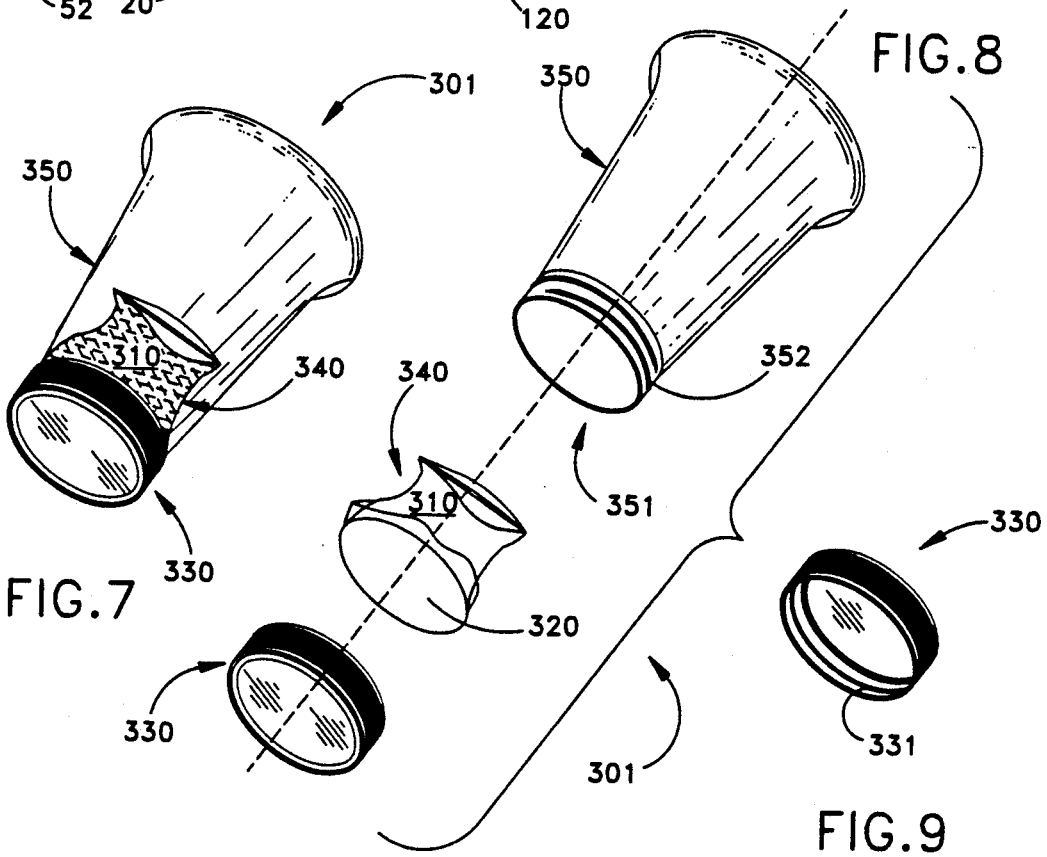
FIG.7
FIG.9

ICE HOLDER INCORPORATED WITHIN A BEVERAGE CONTAINER

BACKGROUND OF THE INVENTION

1. Field of the Invention

The present invention relates to the field of beverage containers. Specifically, the present invention relates to beverage containers which keep the beverage in a main chamber cold by transferring its heat to the ice in a separate chamber which is separated from the main chamber by a polymeric film pouch.

2. Description of the Prior Art

2a. Capsule Summary of the Present Invention For Comparison To The Prior Art

The present invention is a liquid beverage container which has two chambers. There is a chamber for the liquid beverage, and there is another chamber which holds ice. The ice chamber is separated from the beverage chamber by a thin polymeric film pouch.

The ice chamber is bounded by a polymeric film pouch which extends into the container through an opening in the bottom of the container and is sealed at the bottom by a removable cap. The polymeric film pouch is secured at the opening at the bottom of the container and is covered by a cap to keep the ice and melted ice from leaking out of the ice chamber. The polymeric film pouch retains the ice and allows the entrance of the pouch to be secured to the opening at the bottom of the container by the cap.

The polymeric film pouch is a very thin, flexible and stretchable material, and is made of a material which is desired for heat transfer. When the ice is residing in the ice chamber compartment, heat is transferred from the beverage chamber to the cold region in the ice chamber, and the resultant of the heat transfer is a chilled drink which is maintained at a cool temperature.

There are many situations where the present invention is utilized. Fast food restaurants and sporting events involve the consumption of chilled beverages. In fast food restaurants, soft drink makers demand that their beverages be dispensed from equipment designed to produce superior quality beverages, where the syrups are mixed with the carbonated water in a standard ratio in order to get a post-mix product as close to a bottle or a can in quality. However, soft drinks are served with ice to keep the drinks cold. The problem with this is that the ice must melt in order for the beverage to stay cold, in so doing, the syrup to water ratio changes which in effect destroys the beverage quality. Restaurants know this, and even mix drinks purchased at a drive-through window differently from those consumed on-premise in order to counteract the increase of melted ice. But the restaurant cannot control the temperature of the drink's surrounding, and the time it takes for a consumer to drink the beverage, regardless if the drink was purchased at the drive through window or on the premise and taken outside or home later and what about the amount of ice initially served with the beverage, the more ice served the more melted ice. With the present invention, not only will the beverage remain cold for the same period of time as a beverage with the same amount of ice, but the syrup to water ratio will stay constant, thereby, giving the consumer the ultimate quality drink. Its like drinking a cold soft drink from a chilled bottle or can, except now, the consumer gets this experience from start to finish.

In sporting events, besides serving soft drinks with ice, they also serve beer. One of the problems with consuming beer from a paper or plastic cup is that there is no means of keeping the beer cold. Ice is forbidden to be used in beer, and the paper or plastic cup cannot be chilled. According to Grossman's Guide to Beer, beer is the most delicate and perishable food product a restaurant handles and should be served between 40°–45° F., and the nearer the beer is to 45° F., the better it will taste. After the beer is bought, the consumer carries the cup of beer all the way back to their seat, however in doing so, not only has the beer risen in temperature from the environment (much more in the hot sunlight) but also from the heat of their hand, and what about buying beer from a vendor in the seat. Who knows how long this person has been walking around. By the time the consumer drinks his beer, the beer will have lost its ideal temperature. According to a poll done by Sports Illustrated Magazine, about three quarters of the people polled, noted that the beer sold at American sporting events almost always seemed to taste so warm that it was barely drinkable. With the present invention, it will be like drinking beer from a conventional chilled glass, except the paper or plastic cup will remain cold for a more extended period of time than the chilled glass as the ice in the separated compartment will keep it cold.

The present invention can be designed in several embodiments which feature the unique ice chamber separated from the beverage chamber by a polymeric film pouch. One such embodiment could be a disposable or recyclable drinking cup made of paper, plastic or other molding materials and sold at fast food restaurants, sporting events, bars, night clubs, etc. with beer, wine, soft drinks, or other beverages which are consumed cold. Another embodiment could be an attractive reusable plastic drinking cup or glass, where the polymeric film pouch is disposable and/or recyclable used in the home, restaurant, bar, etc. which allows the ice to be retained in the separate compartment to keep beverages chilled without dilution.

At a fast food restaurant or a sporting event, the employee could prepare the present invention as follows. First, the employee prepares the drinking cup with the polymeric film pouch pushed through the opening at the bottom of the cup or could skip this step if the polymeric film pouch is preinstalled. Second, the employee could sweep crushed ice or any other type of ice into the ice chamber. Third, a cap is placed over the opening to the ice chamber. And fourth, the beverage is poured into the beverage container and kept cold by the ice in the ice chamber.

Using the present invention in the home or restaurant, the user could prepare the cup or glass with crushed ice or other types of ice, seal the opening at the bottom of the container, and then pour the desired beverage into the container where the beverage will stay chilled for extended periods of time. Various attractive designs for a cup or glass with the present invention's unique feature of a separate compartment for ice could be presented.

2*b*. Discussion Of Prior Art Patents And Comparison To The Present Invention

The following prior art references are found relevant to the field of the present invention.

1. U.S. Pat. No. 3,369,369 issued to Weiss on Feb. 20, 1968 for "Food Container" (hereafter "the Weiss Patent").

2. U.S. Pat. No. 4,974,423 issued to Pring on Dec. 4, 1990 for "Container for Transport of Frozen Materials such as Biological Samples" (hereafter "the Pring Patent").

3. U.S. Pat. No. 76,378 issued to Bailey on Apr. 7, 1868 for "Improvement in the Construction of Ice-Pitchers" (hereafter "the Bailey Patent").

4. U.S. Pat. No. 93,001 issued to Pietsch on Jul. 27, 1869 for "Improved Pitcher For Cooling Liquids" (hereafter "the Pietsch Patent").

5. U.S. Pat. No. 249,642 issued to Lenz et al. on Nov. 15, 1881 for "Refrigerating-Barrel" (hereafter "the Lenz Patent").

6. U.S. Pat. No. 416,356 issued to Clark on Dec. 3, 1889 for "Water-Cooler" (hereafter "the Clark Patent").

7. U.S. Pat. No. 966,278 issued to Weeks on Aug. 2, 1910 for "Receptacle" (hereafter "the Weeks Patent").

8. U.S. Pat. No. 1,186,418 issued to Mischo on Jun. 6, 1916 for "Freezer Minnow-Bucket" (hereafter "the Mischo Patent").

9. U.S. Pat. No. 2,409,279 issued to Hiller on Oct. 15, 1946 for "Refrigeration Apparatus" (hereafter "the Hiller Patent").

10. U.S. Pat. No. 3,605,433 issued to Strathaus on Sep. 20, 1971 for "Salad Bowl" (hereafter "the Strathaus Patent").

11. U.S. Pat. No. 4,005,586 issued to Lyons on Feb. 1, 1977 for "Refrigerated Butter Dish" (hereafter "the Lyons Patent").

The Lenz Patent discloses a refrigerating barrel. The refrigerating barrel uses an inner chamber which can be filled with ice to keep the contents of the main chamber cold. The Lenz Patent apparatus is generally a large barrel structure, the purpose for which is stated as a means for "transporting oysters across the Atlantic in a fresh condition".

There are significant differences between the present invention, and the Lenz device. First, there is a different purpose. Specifically, whereas the present invention is used for beverages, the Lenz device is utilized for the purpose of carrying oysters. Second, due to the different purpose of the Lenz device, the scaling of the present invention is very different from that of the Lenz device. Third, the present invention involves a polymeric film pouch which separates the ice chamber from the beverage chamber. In contrast, the Lenz device has an inner chamber structure for retaining the ice. This is a very substantial difference which differentiates the present invention from the Lenz device.

Therefore, since the purpose, scale, and the structure of the present invention differ substantially from the Lenz Patent, the present invention is not disclosed in the Lenz Patent.

The Weiss Patent discloses a food container which has an inner chamber capable of mixing chemicals contributing to heat transfer between this inner compartment and the outer compartment where the temperature of consumable goods is altered.

The Pring Patent discloses a container for transport of frozen materials such as biological samples. The portable insulated container comprises a first compartment for receiving material to be transported and a second compartment for receiving and holding a quantity of portable refrigerant in proximity to the first compartment with closures at both compartments remotely spaced to minimize the possibility of cross contamination between compartments. Visible readouts for temperature measurement which would be superfluous to the present invention are specifically claimed in the Pring Patent.

The Bailey Patent discloses an improvement in the construction of ice pitchers. The pitcher is a cylinder within a cylinder configuration which has the benefit of securing the inner cylinder from ice dropped toward the bottom of the region between the two cylinders.

The Pietsch Patent discloses another version of an improved pitcher for cooling liquids of the cylinder within a cylinder type with tubes and arrangements for melted ice from the inner compartment.

The Clark Patent discloses a water cooler configuration where ice is kept in an inner compartment and has the benefit of keeping the ice longer by keeping the melted ice away from the ice. Shelf space within the ice compartment is also provided for general refrigeration purposes.

The Weeks Patent discloses a receptacle which is comprised of an inner and an outer vessel with a removable end for both the inner and outer vessel.

The Mischo Patent discloses a freezer minnow bucket which claims inner and outer containers where a screen at the bottom contributes to adequate drainage from melted ice.

The Hiller Patent discloses a refrigeration apparatus with a tubular core which is to contain refrigerant.

The Strathaus Patent discloses a salad bowl with a refrigerant containing compartment.

The Lyons Patent discloses a refrigerated butter dish where the butter container fits into a crushed ice cylinder.

None of the prior art patents are designed to accommodate a simple drinking cup or glass, or similar beverage container which is designed to consume beverages. Further, none of the prior art devices discloses a simple means for retaining ice which can be in any shape such as cubes, crushed, etc. in a manner which permits the ice to cool the liquid in the container while at the same time not diluting the liquid. In conventional situations, ice is placed directly into the container and the dilution with the beverage such as a soft drink will affect the syrup to water ratio, thereby, reducing the quality of the soft drink. In the case of beverages such as beer, ice is forbidden to use because the direct dilution from ice will appreciably alter its taste. Therefore, there is a significant need for the present invention which can maintain a beverage such as beer and also soft drinks, in a cool state while at the same time not diluting the beverage.

SUMMARY OF THE PRESENT INVENTION

The present invention is a liquid beverage container which keeps beverages chilled for an extended period of time. The beverage container has two chambers: there is a chamber for the liquid beverage; and there is an ice chamber, sealed with a cap and separated from the liquid beverage chamber by a polymeric film pouch, which can be filled with ice to keep the liquid beverage cold.

The construction of the liquid beverage container consists of three constituent parts. The first part is a cup with an opening at the bottom. The second part is a polymeric film pouch (defined more broadly as a film) which is used to hold the ice and separate the ice from the liquid beverage chamber. The third part is a cap which fits to the opening at the bottom of the cup. The cap seals the opening and retains the neck of the polymeric film pouch secured at the opening so that ice or water cannot leak out.

The polymeric film pouch or film is very thin. For example, one half to two mils in thickness has been found to be very efficient for heat transfer purposes. The polymeric film pouch can be formed in a sack-like structure. The polymeric film pouch shaped into a sack structure has an entrance to an inner volume region, an inside surface and an outside surface. The sack structure can be formed from a flat sheet of material or it could be preformed into the sack-like shape.

The sack structure will be extended through the opening at the bottom of the beverage container, displacing the volume of the cup chamber. The sack structure will be able to displace a volume which could be twenty (20) or more percent of the beverage container's cup chamber volume. The volume of the sack will therefore displace the volume of the beverage container's liquid which will be placed into the cup.

The entrance to the sack-like polymeric film pouch is secured at the opening at the bottom of the beverage container. One version of the polymeric film pouch could be described as a plastic bag, with an entrance and an inner and outer surface.

In a plastic bag like structure, the polymeric film pouch can be held by stretching the entrance of the film pouch over a rim and ridge formed into the bottom of the cup. The rim and ridge would be formed about the opening at the bottom of the cup and could be circular or any other shape. The ridge should have an outwardly protruding rim which would serve the purpose of retaining the entrance of the polymeric film pouch around this ridge, and the protruding rim could adapt securely to the cap. Also if needed, the polymeric film pouch could be joined to the rim and/or ridge of the opening at the bottom of the cup using adhesive or fusion means joining techniques. Hence, the ice chamber could be easily filled with ice once the entrance of the polymeric film pouch was stretched over the rim and ridge about the opening at the bottom of the cup, because the film pouch would extend into the hollow of the cup and could be properly joined to the rim and/or ridge of the bottom opening of the cup, and allow the ice chamber to be filled without needing to hold the film pouch in place and the user could fill the ice chamber by scooping the ice into the chamber with one hand. Essentially, a ridge with a protruding lip and if needed, the film pouch properly joined to the rim and/or ridge would enable easy filling of the container with crushed ice or ice cubes because the entrance of the sack-like or bag-like structure would be retained at the bottom opening of the cup. The flexibility of the film pouch permits any shape ice cube or crushed ice to fill the sack-like structure.

The polymeric film pouch can be made out of any flexible and stretchable material which could adequately retain liquid and ice, additionally having the desired properties of heat transfer. Various materials exist which can be formed into various shapes. The polymeric film pouch could be formed into a shape which has an inner surface, an outer surface and an entrance with or without a lip.

In general, the present invention is a liquid beverage container having two chambers and which allows beverages to be retained in the container. There is a chamber for the liquid beverage and there is an ice chamber which is separated from the beverage chamber by a thin polymeric film pouch. The ice chamber is sealed by a cap which is located at the bottom of the container. By filling the ice chamber with ice, the heat transfer between the beverage chamber and the ice chamber keeps the liquid in the beverage chamber cold for extended periods of time.

It has been discovered, according to the present invention, that by fashioning a beverage container with an ice chamber and a beverage chamber, the ice in the ice chamber could keep the liquid in the beverage chamber cold for extended periods of time without allowing the liquid in the beverage chamber to be diluted.

It has further been discovered, according to the present invention, that an ice chamber could be fashioned in the bottom of a beverage container by extending a polymeric film pouch through an opening in the bottom of the beverage container and filling a volume of the film pouch with ice.

It has also been discovered, according to the present invention, that the ice in the ice chamber could be retained by placing a plug cap into the opening, thereby, the entrance to the polymeric film pouch can be closed.

It has additionally been discovered, according to the present invention, that the ice in the ice chamber could be secured by having a container with a threaded base section and a threaded cap, then screwing the cap onto the bottom of the container, thereby sealing the bottom entrance to the polymeric film pouch which holds the ice.

It has also been discovered, according to the present invention, that the ice in the ice chamber could be secured by having a paper cup with a separate plastic bottom and plug cap, then the plastic bottom can be attached to the extended rim of the paper cup, then placing a plug cap into the opening of the plastic bottom, thereby, sealing the bottom entrance to the polymeric film pouch which holds the ice.

It has further been discovered, according to the present invention, that the ice in the ice chamber could be retained by placing a grasping cap over a ridge-like protuberance around the opening at the bottom of the cup, thereby sealing the entrance to the polymeric film pouch which holds the ice.

It is therefore an object of the present invention to provide a beverage container with an ice chamber and a beverage chamber, so that the ice in the ice chamber would keep the liquid in the beverage chamber cold for extended periods of time without allowing the liquid in the beverage chamber to be diluted.

It is a further object of the present invention to provide an ice chamber which could be fashioned in the bottom of a beverage container by extending a polymeric film pouch through an opening in the bottom of the beverage container so that the volume of the film pouch could be filled with ice.

It is also an object of the present invention to provide a means for retaining the ice in the ice chamber by placing a plug cap over the opening, the cap being affixed to a rim and ridge structure which partially retains the polymeric film pouch which closes the entrance to the ice chamber.

It is an additional object of the present invention to provide a means for securing the ice in the ice chamber by having a container with a threaded base section and with a threaded cap. The cap is screwed onto the bottom of the container thereby sealing the bottom entrance to the polymeric film pouch which holds the ice.

It is also an object of the present invention to provide an attachable plastic bottom with a plug cap, so that the plastic bottom can be used with paper cup products.

It is a further object of the present invention to retain the ice in the ice chamber by providing a grasping cap over a ridge-like protuberance around the opening at the bottom of the cup thereby sealing the entrance to the polymeric film pouch which holds the ice.

In the preferred embodiment of the present invention, the beverage container is comprised of three constituent parts. First, there is a cup with an opening at the bottom, where the opening has a circular or any other shape rim and ridge structure proximal to the periphery of the opening. Second, there is a polymeric film pouch which will extend a sack-like structure into the cup through the opening at the bottom and will generally be retained at the rim and ridge structure at the opening located at the bottom of the cup, and could include adhesive or fusion means appropriately joined to the rim and/or ridge structure at the bottom opening of the cup. Third, there is a cap which will adapt to the opening of the cup, plugging the opening at the bottom of the cup and sealing the polymeric film pouch about the opening at the bottom of the cup, and closing the entrance to the polymeric film pouch structure within the cup, so that ice placed in the sack-like structure will be retained without leakage.

In an alternative embodiment of the present invention, the beverage container is comprised of three constituent parts. First, there is a cup with an opening at the bottom, where the opening has a circular or any other shape rim and ridge structure proximal to the periphery of the opening. Second, there is a polymeric film pouch which will extend a sack-like structure into the cup through the opening at the bottom and will generally be retained at the rim and ridge structure at the opening located at the bottom of the cup, and could include adhesive or fusion means appropriately joined to the rim and/or ridge structure at the bottom opening of the cup. Third, there is a cap which will adapt to the opening of the cup, clamping the polymeric film pouch about the ridge at the bottom of the cup, sealing the entrance to the sack-like structure within the cup, so that ice placed in the sack-like structure will be retained without leakage.

In another alternative embodiment of the present invention, the beverage container is comprised of three constituent parts. First, there is a cup with a threaded base section and an opening at the bottom, where the opening has a circular or threaded structure circularly proximal to the periphery of the opening. Second, there is a polymeric film pouch which will extend a sack-like structure into the cup through the opening at the bottom and will generally be retained at the circular threaded structure at the opening located at the bottom of the cup. Third, there is a threaded cap which will adapt to the opening of the cup, screwing the cap to the bottom of the cup and sealing the polymeric film pouch about the opening at the bottom of the cup, and closing the entrance to the polymeric film pouch structure within the cup, so that ice placed in the sack-like structure will be retained without leakage.

In another alternative embodiment of the present invention, the beverage container is comprised of four constituent parts. First, there is a paper cup with an opening at the bottom portion. Second, there is a plastic bottom with an opening, where the opening has a circular or any other shape ridge structure proximal to the periphery of the opening. The plastic bottom having a downwardly circumferential edge structure is placed into the hem section of the extended base section of the paper cup and is glued together to form the base of the paper cup. Third, there is a polymeric film pouch which will extend a sack-like structure into the paper cup through the opening at the base and will generally be retained at the rim and ridge structure at the opening located at the base of the paper cup, and could be adhesive or fusion means appropriately joined to the rim and/or ridge structure at the base opening of the paper cup. Fourth, there is a cap which will adapt to the opening of the plastic bottom, plugging the polymeric film pouch about the rim and ridge at the base of the plastic bottom, sealing the entrance to the sack-like structure within the paper cup, so that ice placed in the sack-like structure will be retained without leakage.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a cross-sectional view of an inverted beverage container, showing the ice chamber at the bottom of the container.

FIG. 2 is a perspective view of an inverted cup with an opening at the bottom, the polymeric film pouch partially extending through the opening, and the cap shown removed to expose the opening to the polymeric film pouch.

FIG. 3 is a cross-sectional elevational view of a plug cap which seats to the opening at the bottom of the beverage container which holds the polymeric film pouch in place by pushing into the opening and the polymeric film pouch, with the cap removed from the polymeric film pouch.

FIG. 4 is a cross-sectional elevational view of a grasping cap which grasps the polymeric film pouch and seals the ice chamber at the ridge protuberance located peripheral to the opening at the bottom of the cup, and the polymeric film pouch, with the cap removed from the polymeric film pouch.

FIG. 5 is a cross-sectional view of an inverted beverage container, showing the ice chamber at the bottom of the container where the cap, rather than the extended base or cup bottom acts as a coaster that touches the surface when the container is in the upright position.

FIG. 6 is a cross-sectional elevational view of a plug cap which seats to the opening at the bottom of the beverage container which holds the polymeric film pouch in place by pushing into the opening and the polymeric film pouch, with the cap removed from the polymeric film pouch.

FIG. 7 is a perspective view of a cup which holds the polymeric film pouch in place and the cap screwed onto the bottom of the cup.

FIG. 8 is an exploded view of a cup with a threaded base section with an opening at the bottom, a polymeric film pouch and a threaded cap.

FIG. 9 is a perspective view of a cap with the interior threaded sidewall.

DESCRIPTION OF THE PREFERRED EMBODIMENT

Figure 10:
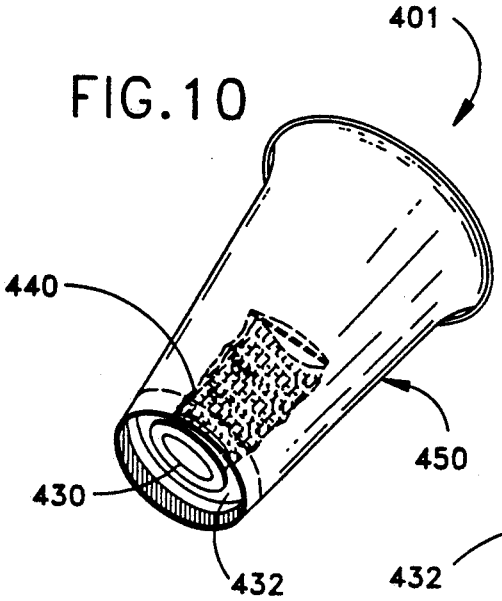
FIG. 10 is a perspective view of a paper cup which holds the polymeric film pouch in place and the bottom portion is attached to the hem section of the paper cup with the cap plugged in place.
Figure 10:
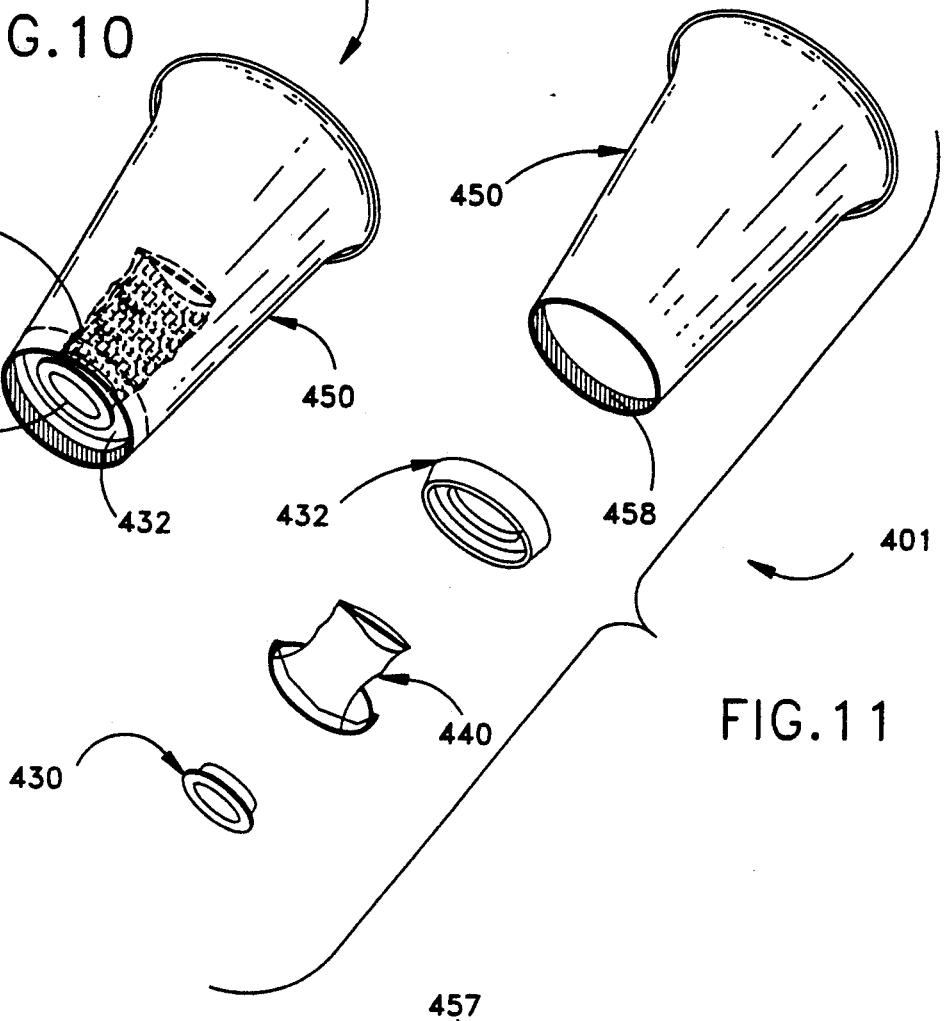

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, the beverage container 1 is shown. The beverage container 1 can be made from three pieces: the three piece design consists of a cup 50, shown inverted, with an opening 5 through the bottom 45 of the cup 50; a plug cap 30 which fits through the opening 5 of the cup 50; and a polymeric film pouch 40 which could be held in place by an adhesive or fusion means 42 and the plug cap 30.

The beverage container 1 has two chambers, a cup chamber 15, and an ice chamber 10. The polymeric film pouch 40 acts as a diaphragm which separates the ice chamber 10 from the cup chamber 15. There is an opening 5 through the cup bottom 45 of the cup 50 which the plug cap 30 is pushed through. The cap 30, the cup bottom 45, and if used the adhesive or fusion means 42 hold the polymeric film pouch 40 in place when the plug cap 30 is fitted to the opening 5 at the cup bottom 45. The opening 5 is coincident with the diaphragm entrance 105 as the plug cap 30 is in place. The opening 5 has an opening diameter $D_0$, which corresponds to a generally circular opening at the cup bottom 45. However, the opening 5 does not need to be circular.

The beverage container 1 can be made from several materials. A manufacturing process which could accommodate the construction of the beverage container 1 is an injection, thermoform, etc. molding process. The cup 50 and the plug cap 30 could be made separately or in a one piece injection, thermoform, etc. molding process, then separated when assembled. Several types of caps could be configured to accommodate the various cup designs to a person skilled in the art of process molding. In addition, the polymeric film pouch 40 is also available from a number of sources to conform to the cup and cap configuration, and can be preinstalled. Several polymers which are available in the current market could be adapted for the polymeric film pouch 40 and also can be preinstalled. The molding and mass production process would enable the beverage container 1 to be produced inexpensively, thereby making the present invention available to the consumer at a low cost. The present invention is a viable article of manufacture, with realistic cost expenditures associated with its production.

The polymeric film pouch 40 has an inner diaphragm surface 110, and an outer diaphragm surface 100. The ice in the ice chamber 10 is sealed by the polymeric film pouch at the inner diaphragm surface 110 boundary. The polymeric film pouch 40 has a diaphragm entrance 105, which is sealed by the plug cap 30. Other means exist for sealing the diaphragm entrance 105 of the polymeric film pouch 40. Referring to FIG. 4, there is a grasping cap 32 design, showing one other configuration which serves the function of sealing the diaphragm entrance 105 of the polymeric film pouch 40. Of course, the present invention is not intended to be limited to a plug cap 30 and a grasping cap 32 design to seal the diaphragm entrance 105 of the polymeric film pouch 40.

Referring to FIG. 1, the cup 50 has a cup lip 52 with or without a flared out rim ridge 56 which is rounded to be less abrasive to the lips when drinking out of the cup 50. There is also an extended base 54, which forms a recess for the opening 5 at the cup bottom 45, so that when the cup 50 is upright, the plug cap 30 or other capping device does not upset the stability of the generally flat cup bottom. Through an extended base 54, shown formed as a lip around the periphery of the cup bottom 45, the cup 50 can be placed in an upright position and will not be sitting on the plug cap 30 which would tend to tip over. The extended base 54 could be made wider at the cup bottom 45, to the extent that it reaches the flared cap lip 33 of the plug cap 30.

Various extended base 54 configurations could exist for the purpose of providing a recessed area for the opening of the cup bottom 45 and the corresponding cap which is used to seal the diaphragm entrance 105 of the polymeric film pouch 40.

The cup 50 also has a cup chamber 15 which holds the liquid beverage. The volume of the cup chamber 15 will be reduced by the displacement of the ice chamber 10 volume. The cup 50 will have a periphery with an inner cup surface 120 and an outer cup surface 130.

Referring to FIG. 2, a perspective view of the beverage container 1, with its constituent parts, the cup 50, the plug cap 30 (shown removed) and the polymeric film pouch 40 is illustrated. At the cup bottom 45, there is an opening 5 which is large enough for the plug cap 30 to partially push through, thereby sealing the diaphragm entrance 105 of the polymeric film pouch 40. The plug cap 30 has a cap sidewall taper 37 which allows the plug cap 30 to partially push through the diaphragm entrance 105 of the polymeric film pouch 40 and the opening 5 of the cup bottom 45.

The opening 5 of the cup bottom 45 has an opening rim 7 and a rim ridge 9 (see FIG. 4) which is a generally circular flared out protuberance which could hold the polymeric film pouch 40 at the neck 107. The polymeric film pouch 40 is lowered into the opening 5 of the cup bottom 45 until the diaphragm entrance 105 exposes the inner diaphragm surface 110 at the opening 5 of the cup bottom 45. The interfacing lip at the entrance 105 where the inner diaphragm surface 110 and the outer diaphragm surface 100 of the polymeric film pouch 40 interface, is stretched over the opening rim 7 and the rim ridge 9 at the opening of the cup bottom 45 and could be attached to the opening rim 7 and/or rim ridge 9 by adhesive or fusion means 42. This holds the polymeric film pouch 40 securely so that ice can be placed into the ice chamber 10 without holding the polymeric film pouch 40 to the opening 5 of the cup bottom 45 by hand.

The polymeric film pouch 40 has an entrance 105 which is sealed by the plug cap 30. The polymeric film pouch 40 generally forms a sack which extends into the cup chamber 15 displacing the volume of the cup chamber 15 with the volume created by the ice within the polymeric film pouch 40. The polymeric film pouch 40 has an outer diaphragm surface 100 which is exposed to the liquid of the cup chamber 15. There is also an inner diaphragm surface 110 which is exposed to the ice in the ice chamber 10. There is an entrance 105 which is sealed at the opening 5 of the cup bottom 45 by the plug cap 30. The plug cap 30 seals the entrance 105 of the polymeric film pouch 40.

The polymeric film pouch 40 forms the ice chamber 10. The polymeric film pouch 40 can be made from any number of materials. The material should be impermeable, flexible and stretchable so the liquid in the cup chamber 15 will not be diluted. The material should also be thin and with desired heat transfer properties. The material should also be able to hold crushed ice or ice cubes without piercing or tearing.

Referring to FIG. 3, the plug cap 30 seals the entrance 105 of the polymeric film pouch 40. The plug cap 30 fits to the opening 5 at the cup bottom 45. There is a cap sidewall taper 37 at the periphery of the plug cap 30. There are two important diameters of the plug cap 30. The two diameters are the widened cap diameter $D_1$ and the narrowed cap diameter $D_2$. These two diameters are due to the generally gradual cap sidewall taper 37 which allows the plug cap 30 to be wedged into the opening 5 of the cup bottom 45. The narrowed cap diameter can be equal to or less than the opening diameter $D_0$ at the opening 5 of the cup bottom 45, depending on the materials used. The cap sidewall taper 37 needs to converge enough to create a slightly compressed fit to the opening 5 at the cup bottom 45. The plug cap 30 can also have a flared cap lip 33 which could allow a person handling the plug cap 30 to pull it out of the opening 5.

The polymeric film pouch 40 is shown secured by the rim ridge 9 at the opening rim 7 of the cup bottom 45 of the beverage container 1. Also, the polymeric film pouch 40 could be joined to the opening rim 7 and/or rim ridge 9 of the opening 5 at the cup bottom 45 of the beverage container 1, using adhesive or fusion means joining techniques. By securing the polymeric film pouch 40 in this manner, the ice chamber 10 is prepared for the insertion of ice.

Referring to FIG. 4, an alternative cap design is shown. A grasping cap 32, which attaches to the rim ridge 9, about the opening rim 7, at the cup bottom 45, is shown. In this depiction, the grasping rim 35 clamps around the rim ridge 9, and can be in contact with the opening rim 7, thereby holding the polymeric film pouch 40 in place about the rim ridge 9. The ice chamber 10 forms a volume which can be filled with ice. There is one significant diameter involved with this design. The grasping cavity diameter $D_3$, where the grasping cavity diameter $D_3$ should accommodate the rim ridge 9 which is flared out from the opening rim 7.

Referring to FIGS. 5 and 6, an alternative cup and cap design are shown. The designs are the same as FIGS. 1 and 3, except the cap sidewall taper 237 of cap 230 is longer than the cap sidewall taper 37 of cap 30, therefore, when the cap 230 seals the entrance 105 of the polymeric film pouch 40, the cap lip 233 of plug cap 230 will be above the extended base 54, thus, will touch the surface, etc. when the beverage container 1 is in the upright position. The cap lip 233 now acts as a coaster. The plug cap 230 functions the same as previously described in FIGS. 1 through 3.

Referring to FIGS. 7 and 8, another embodiment of a cup and a cap design are shown. Referring to FIG. 7, a perspective view of the beverage container 301, with its constituent parts, the cup 350, the screw cap 330 and the polymeric film pouch 340 is illustrated.

Referring to FIG. 8, there is shown an exploded view of the beverage container 301 with its constituent parts separated. The beverage container 301 comprises of a cup 350, a threaded cap 330 and a polymeric film pouch 340, as shown. The cup 350 has a threaded base section 352 for the threaded cap 330 to be mated, thereby sealing the diaphragm entrance 320 of the polymeric film pouch 340. In operation, the polymeric film pouch 340 is placed over the threaded base section 352 of the cup 350. By placing his or her fingers over the threaded base section 352, the polymeric film 340 is pushed into the cup opening 351 with his or her other fingers. The ice is placed into the ice chamber 310 and the screw cap 330 is screwed onto the cup threaded base section 352 so the polymeric film pouch 340 will be secure. The beverage container is now ready to be used.

Referring to FIG. 9, there is shown a screw cap 330. The screw cap 330 has an interior threaded sidewall 331 which allows the screw cap 330 to be mated to the cup 350 threaded base section 352.

Figure 11:
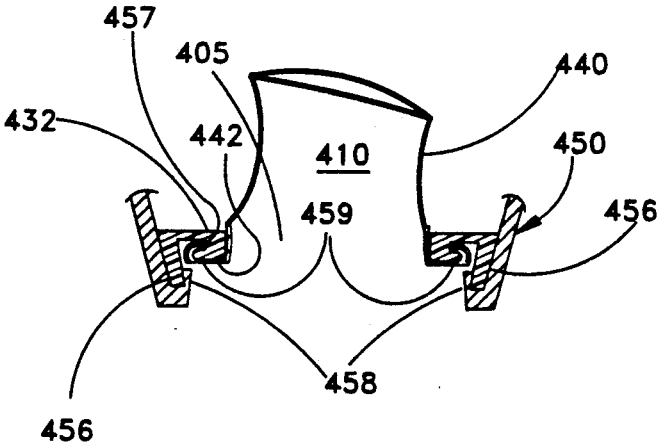
FIG. 11 is an exploded view of a paper cup with a hem section at the extended base, a bottom portion, a polymeric film pouch and a cap.

Referring to FIGS. 10 and 11, there is shown another alternative embodiment of a cup and a cap design. Referring to FIG. 10, there is illustrated a perspective view of the beverage container 401, with its constituent parts; a paper cup 450, a plug cap 430, an attachable bottom 432 and the polymeric film pouch 440.

Referring to FIG. 11, there is shown an exploded view of the beverage container 401 with its constituent parts separated. The beverage container 401 comprises of a paper cup 450, a plug cap 430, an attachable bottom 432 and a polymeric film pouch 440, as shown. The paper cup 450 has a hem section 458 at its extended base for mating with the attachable bottom 432 and forming the base of the paper cup 450. The plug cap 430 functions the same as plug cap 30 discussed in FIGS. 1 through 3. Of course, the present invention is not intended to be limited to only the plug cap 430 design.

Figure 12:
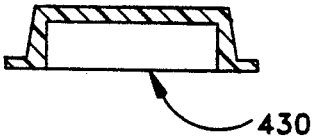
FIG. 12 is a cross-sectional elevational view of a cap which seats to the opening of the attachable bottom which mates to the hem section of the container.

Referring to FIGS. 11 and 12, there is illustrated the attachable bottom 432 having a downwardly tapered circumferential edge 456 assembled to mate with the hem section 458 of the extended base of the paper cup 450 using the appropriate assembly and joining techniques. The attachable bottom 432 could be constructed from paper, plastic or etc. The attachable bottom 432 and plug cap 430 could be made from several materials and made separately or in a one piece injection, thermoform, etc. molding process, then separated when assembled.

The opening 405 of the attachable bottom 432 has an opening rim 457 and a rim ridge 459 which is a generally circular flared out protuberance which could hold the polymeric film pouch 440. The polymeric film pouch 440 is lowered into the opening 405 of the attachable bottom 432, is stretched over the opening rim 457 and the rim ridge 459 at the opening of the attachable bottom 432 and could be attached to the opening rim 457 and/or the rim ridge 459 by adhesive or fusion means 442. This holds the polymeric film pouch 440 securely so that ice can be placed into the ice chamber 410 without holding the polymeric film pouch 440 to the opening 405 of the attachable bottom 432 by hand.

Defined in detail, the present invention is a beverage container comprising: (a) a container having a circumferential sidewall and a base which define an interior beverage chamber; (b) said base of said container having an opening, where the opening has an opening rim and a flared out rim ridge which is proximal to the periphery of the opening at said base of said container; (c) an impermeable, flexible and stretchable polymeric film pouch forming an interior chamber having an opening at one end; (d) said polymeric film pouch extending into said interior beverage chamber of said container through the opening of said base and retained thereby through the flexible and stretchable opening which extends over the opening rim and said flared out rim ridge and is attached thereto by an attaching means; and (e) a removable cap member which adapts to the opening at said base for sealing purposes thereof by plugging the opening at said base of said container and squeezing the opening of said polymeric film pouch against the opening rim and said rim ridge; (f) whereby prior to plugging said removable cap member, said polymeric film pouch is filled with ice and is then sealed, a cool liquid beverage is poured into said container and the beverage retains its cool temperature through heat transfer with the ice in said polymeric film pouch.

Alternatively defined in detail, the present invention is a beverage container comprising: (a) a container having a circumferential sidewall and a base which define an interior beverage chamber; (b) said base of said container having an opening, where the opening has an opening rim and a flared out rim ridge which is proximal to the periphery of the opening at said base of said container; (c) an impermeable, flexible and stretchable polymeric film pouch forming an interior chamber having an opening at one end; (d) said polymeric film pouch extending into said interior beverage chamber of said container through the opening of said base and retained thereby through the flexible and stretchable opening which extends over the opening rim and said flared out rim ridge and is attached thereto by an attaching means; and (e) a removable cap member which adapts to the opening at said base by clamping the polymeric film pouch about the rim ridge of the rim opening at said base of said container, thereby sealing the entrance to said polymeric film pouch; (f) whereby prior to clamping said removable cap member, said polymeric film pouch is filled with ice and is then sealed, a cool liquid beverage is poured into said container and the beverage retains its cool temperature through heat transfer with the ice in said polymeric film pouch.

Also defined alternatively in detail, the present invention is a beverage container comprising: (a) a container having a circumferential sidewall and a base which define an interior beverage chamber; (b) said base of said container having an opening, where the opening has an opening rim and a flared out rim ridge which is proximal to the periphery of the opening at said base of said container; (c) an impermeable, flexible and stretchable polymeric film pouch forming an interior chamber having an opening at one end; (d) said polymeric film pouch extending into said interior beverage chamber of said container through the opening of said base and retained thereby through the flexible and stretchable opening which extends over the opening rim and said flared out rim ridge and is attached thereto by an attaching means; and (e) a cover member which adapts to the opening at said base for sealing purpose thereof by squeezing the opening of said polymeric film pouch against the opening rim and said rim ridge; (f) whereby prior to plugging said cover member, said polymeric film pouch is filled with ice and is then sealed, a cool liquid beverage is poured into said container and the beverage retains its cool temperature through heat transfer with the ice in said polymeric film pouch.

Defined broadly, the present invention is a beverage container comprising: (a) a cup having a base which has an opening; (b) a film extends into said cup through said opening at said base which is retained at the opening located in said base of said cup such that the ice is deposited into said film; and (c) a cap securing said opening of said base and sealing the ice within said film; (d) whereby said film is filled with ice and a cool liquid beverage is poured into said cup and the beverage retains its cool temperature through heat transfer with the ice in said film.

Further defined in detail, the present invention is a beverage container comprising: (a) a container having a circumferential threaded base section and a base; (b) said base being configured to have an opening, which opens to an interior beverage chamber of said container; (c) an impermeable, flexible and stretchable polymeric film pouch forming an interior chamber having an opening at one end; (d) said opening end of said polymeric film pouch placed over said threaded base section and said polymeric film pouch extending into said interior beverage chamber of said container; (e) a removable lid having a threaded interior sidewall; and (f) said threaded interior sidewall of said removable lid screwed onto said threaded base section of said container and pressing the opening of said polymeric film pouch against said threaded base section of said container; (g) whereby prior to screwing said removable lid, said polymeric film pouch is filled with ice and is then sealed, a cool liquid beverage is poured into said container and the beverage retains its cool temperature through heat transfer with the ice in said polymeric film pouch.

Further defined broadly, the present invention is a beverage container comprising: (a) a container having a circumferential base section and a base; (b) said base having an opening which opens into an interior beverage chamber of said container; (c) a film pouch forming an interior chamber and at least one opening end, which extends over said base section of said container; and (d) a lid mounted onto said base section of said container and pressing the opening of said film pouch against said base section of said container;(e) whereby prior to engaging said lid, said film pouch is filled with ice and a cool liquid beverage is poured into said container and the beverage retains its cool temperature through heat transfer with the ice in said film pouch.

Further defined more broadly, the present invention is a beverage container comprising: (a) a cup having a base means; (b) said base means having an opening which opens to an interior chamber of said cup; (c) a film extending into said cup through said opening of said base means and forming an interior chamber with an opening which is retained over said base means of said cup, where the ice is deposited into said interior chamber; and (d) a lid means securing said opening at said base means and sealing the ice within said interior chamber formed by said film; (e) whereby said interior chamber formed by said film is filled with ice and a cool liquid beverage is poured into said cup and the beverage retains its cool temperature through heat transfer with the ice in said film.

Also further defined in detail, the present invention is a beverage container comprising: (a) a container having a circumferential sidewall and a hem section with an opening; (b) an attachable bottom portion having a downwardly tapered circumferential edge which mates with said hem section of said container and forms a base for said container; (c) said circumferential sidewall and said base defining an interior beverage chamber; (d) said attachable bottom portion having an opening, which has an opening rim and a flared out rim ridge; (e) an impermeable, flexible and stretchable polymeric film pouch forming an interior chamber having an opening at one end; (f) said polymeric film pouch extending into said interior beverage chamber of said container through the opening of said attachable bottom portion and retained thereby through the flexible and stretchable opening which extends over the opening rim and said flared out rim ridge and is attached thereto by an attaching means; and (g) a removable cap member which adapts to the opening at said attachable bottom portion for sealing purpose thereof by plugging the opening at said attachable bottom portion and squeezing the opening of said polymeric film pouch against the opening rim and said rim ridge; (h) whereby prior to plugging said removable cap member, said polymeric film pouch is filled with ice and is then sealed, a cool liquid beverage is poured into said container and the beverage retains its cool temperature through heat transfer with the ice in said polymeric film pouch.

Also further defined broadly, the present invention is a beverage container comprising: (a) a cup having a sidewall and a hem with an opening; (b) a bottom having an opening and a downward edge which mates with said hem of said cup and forms a base for said cup; (c) a film extending into said cup through said opening of said bottom and forming an interior chamber, where the ice is deposited into said film; and (d) a cap securing said opening of said bottom and sealing the ice within said film; (e) whereby said film is filled with ice and a cool liquid beverage is poured into said cup and the beverage retains its cool temperature through heat transfer with the ice in said film.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A beverage container comprising:

a. a container having a circumferential sidewall and a base which define an interior beverage chamber;

b. said base of said container having an opening, where the opening has an opening rim and a flared out rim ridge which is proximal to the periphery of the opening at said base of said container;

c. an impermeable, flexible and stretchable polymeric film pouch forming an interior chamber having an opening at one end;

d. said polymeric film pouch extending into said interior beverage chamber of said container through the opening of said base and retained thereby through the opening in the flexible and stretchable film which extends over the opening rim and said flared out rim ridge and is attached thereto by an attaching means; and e. a removable cap member which adapts to the opening at said base for sealing purposes thereof by plugging the opening at said base of said container and squeezing the opening of said polymeric film pouch against the opening rim and said rim ridge;

f. whereby prior to plugging said removable cap member, said polymeric film pouch is filled with ice and is then sealed, a cool liquid beverage is poured into said container and the beverage retains its cool temperature through heat transfer with the ice in said polymeric film pouch.

2. The invention in accordance with claim 1 wherein the opening at said base of said container is recessed by an extended base so said container will not be seated on said removable cap member when said container is in the upright position.

3. The invention in accordance with claim 1 wherein said container and said removable cap member are manufactured in an injection molding process.

4. The invention in accordance with claim 1 wherein said container and said removable cap member are made of plastic.

5. The invention in accordance with claim 1 wherein said attaching means is adhesive.

6. The invention in accordance with claim 1 wherein said attaching means is fusion.

7. A beverage container comprising:

a. a container having a circumferential sidewall and a base which define an interior beverage chamber;

b. said base of said container having an opening, where the opening has an opening rim and a flared out rim ridge which is proximal to the periphery of the opening at said base of said container;

c. an impermeable, flexible and stretchable polymeric film pouch forming an interior chamber having an opening at one end;

d. said polymeric film pouch extending into said interior beverage chamber of said container through the opening of said base and retained thereby through the opening in the flexable and stretchable film which extends over the opening rim and said flared out rim ridge and is attached thereto by an attaching means; and e. a removable cap member which adapts to the opening at said base by clamping the polymeric film pouch about the rim ridge of the rim opening at said base of said container, thereby sealing the entrance to said polymeric film pouch;

f. whereby prior to clamping said removable cap member, said polymeric film pouch is filled with ice and is then sealed, a cool liquid beverage is poured into said container and the beverage retains its cool temperature through heat transfer with the ice in said polymeric film pouch.

8. The invention in accordance with claim 7 wherein the opening at said base of said container is recessed by an extended lower sidewall so said container will not be seated on said removable cap member when said container is in the upright position.

9. The invention in accordance with claim 7 wherein said container and said removable cap member are manufactured in an injection molding process.

10. The invention in accordance with claim 7 wherein said container and said removable cap member are made of plastic.

11. The invention in accordance with claim 7 wherein said attaching means is adhesive.

12. The invention in accordance with claim 7 wherein said attaching means is fusion.

13. A beverage container comprising:

a. a container having a circumferential sidewall and a base which define an interior beverage chamber;

b. said base of said container having an opening, where the opening has an opening rim and a flared out rim ridge which is proximal to the periphery of the opening at said base of said container;

c. an impermeable, flexible and stretchable polymeric film pouch forming an interior chamber having an opening at one end;

d. said polymeric film pouch extending into said interior beverage chamber of said container through the opening of said base and retained thereby through the opening in the flexible and stretchable film which extends over the opening rim and said flared out rim ridge and is attached thereto by an attaching means; and e. a cover member which adapts to the opening at said base for sealing purpose thereof by squeezing the opening of said polymeric film pouch against the opening rim and said rim ridge;

f. whereby prior to plugging said cover member, said polymeric film pouch is filled with ice and is then sealed, a cool liquid beverage is poured into said container and the beverage retains its cool temperature through heat transfer with the ice in said polymeric film pouch.

14. The invention in accordance with claim 13 wherein said cover member acts as a coaster for said container.

15. The invention in accordance with claim 13 wherein said container and said cover member are manufactured in an injection molding process.

16. The invention in accordance with claim 13 wherein said container and said cover member are made of plastic.

17. The invention in accordance with claim 13 wherein said attaching means is adhesive.

18. The invention in accordance with claim 13 wherein said attaching means is fusion.

19. A beverage container comprising:

a. a cup having a base which has an opening;

b. a film extends into said cup through said opening at said base which is retained at the opening located in said base of said cup such that the ice is deposited into said film; and c. a cap securing said opening of said base and sealing the ice within said film;

d. whereby said film is filled with ice and a cool liquid beverage is poured into said cup and the beverage retains its cool temperature through heat transfer with the ice in said film.

20. The invention in accordance with claim 19 wherein said film is made of polymeric material.

21. The invention in accordance with claim 19 wherein said film is impermeable, flexible and stretchable.

22. The invention in accordance with claim 19 wherein said cup and said cap are made of plastic.

23. The invention in accordance with claim 19 wherein said cup and said cap are manufactured in an injection molding process.

24. A beverage container comprising:

a. a container having a circumferential threaded base section and a base;

b. said base being configured to have an opening, which opens to an interior beverage chamber of said container;

c. an impermeable, flexible and stretchable polymeric film pouch forming an interior chamber having an opening at one end;

d. said opening end of said polymeric film pouch placed over said threaded base section and said polymeric film pouch extending into said interior beverage chamber of said container;

e. a removable lid having a threaded interior sidewall; and f. said threaded interior sidewall of said removable lid screwed onto said threaded base section of said container and pressing the opening of said polymeric film pouch against said threaded base section of said container;

g. whereby prior to screwing said removable lid, said polymeric film pouch is filled with ice and is then sealed, a cool liquid beverage is poured into said container and the beverage retains its cool temperature through heat transfer with the ice in said polymeric film pouch.

25. The invention in accordance with claim 24 wherein said container and said removable lid are manufactured in an injection molding process.

26. The invention in accordance with claim 24 wherein said container and said removable lid are made of plastic.

27. A beverage container comprising:

a. a container having a circumferential base section and a base;

b. said base having an opening which opens into an interior beverage chamber of said container;

c. a film pouch forming an interior chamber and at least one opening end, which extends over said base section of said container; and d. a lid mounted onto said base section of said container and pressing the opening of said film pouch against said base section of said container;

e. whereby prior to engaging said lid, said film pouch is filled with ice and a cool liquid beverage is poured into said container and the beverage retains its cool temperature through heat transfer with the ice in said film pouch.

28. The invention in accordance with claim 27 wherein said container and said lid are manufactured in an injection molding process.

29. The invention in accordance with claim 27 wherein said container and said lid are made of plastic.

30. The invention in accordance with claim 27 wherein said film pouch is made of polymeric material.

31. A beverage container comprising:

a. a cup having a base means;

b. said base means having an opening which opens to an interior chamber of said cup;

c. a film extending into said cup through said opening of said base means and forming an interior chamber with an opening which is retained over said base means of said cup, where the ice is deposited into said interior chamber; and d. a lid means securing said opening at said base means and sealing the ice within said interior chamber formed by said film;

e. whereby said interior chamber formed by said film is filled with ice and a cool liquid beverage is poured into said cup and the beverage retains its cool temperature through heat transfer with the ice in said film.

32. The invention in accordance with claim 31 wherein said cup and said lid means are manufactured in an injection molding process.

33. The invention in accordance with claim 31 wherein said cup and said lid means are made of plastic.

34. The invention in accordance with claim 31 wherein said film is made of polymeric material.

35. A beverage container comprising:

a. a container having a circumferential sidewall and a hem section with an opening;

b. an attachable bottom portion having a downwardly tapered circumferential edge which mates with said hem section of said container and forms a base for said container;

c. said circumferential sidewall and said base defining an interior beverage chamber;

d. said attachable bottom portion having an opening, which has an opening rim and a flared out rim ridge;

e. an impermeable, flexible and stretchable polymeric film pouch forming an interior chamber having an opening at one end;

f. said polymeric film pouch extending into said interior beverage chamber of said container through the opening of said attachable bottom portion and retained thereby through the the opening in the flexible and stretchable polymeric film pouch which extends over the opening rim and said flared out rim ridge and is attached thereto by an attaching means; and g. a removable cap member which adapts to the opening at said attachable bottom portion for sealing purpose thereof by plugging the opening at said attachable bottom portion and squeezing the opening of said polymeric film pouch against the opening rim and said rim ridge;

h. whereby prior to plugging said removable cap member, said polymeric film pouch is filled with ice and is then sealed, a cool liquid beverage is poured into said container and the beverage retains its cool temperature through heat transfer with the ice in said polymeric film pouch.

36. The invention in accordance with claim 35 wherein the opening of said attachable bottom portion is recessed by an extended base so said container will not be seated on said removable cap member when said container is in the upright position.

37. The invention in accordance with claim 35 wherein said container, said attachable bottom portion and said removable cap member are manufactured in an injection molding process.

38. The invention in accordance with claim 35 wherein said container, said attachable bottom portion and said removable cap member are made of plastic.

39. The invention in accordance with claim 35 wherein said container, said attachable bottom portion and said removable cap member are made of paper.

40. The invention in accordance with claim 35 wherein said attaching means is adhesive.

41. The invention in accordance with claim 35 wherein said attaching means is fusion.

42. A beverage container comprising:

a. a cup having a sidewall and a hem with an opening;

b. a bottom having an opening and a downward edge which mates with said hem of said cup and forms a base for said cup;

c. a film extending into said cup through said opening of said bottom and forming an interior chamber, where the ice is deposited into said film; and d. a cap securing said opening of said bottom and sealing the ice within said film;

e. whereby said film is filled with ice and a cool liquid beverage is poured into said cup and the beverage retains its cool temperature through heat transfer with the ice in said film.

43. The invention in accordance with claim 42 wherein said film is made of polymeric material.

44. The invention in accordance with claim 42 wherein said cup, said bottom and said cap are manufactured in an injection molding process.

45. The invention in accordance with claim 42 wherein said cup, said bottom and said cap are made of plastic.

46. The invention in accordance with claim 42 wherein said cup, said bottom and said cap are made of paper.

47. The invention in accordance with claim 42 wherein said film is impermeable, flexible and stretchable.

* * * * *